United States Patent [19]

Sharon

[11] Patent Number: 4,987,620

[45] Date of Patent: Jan. 29, 1991

[54] COMBINED BED AND WHEELCHAIR

[76] Inventor: Benjamin Sharon, 6 Kipnis Street, Rehovot, Israel

[21] Appl. No.: 416,426

[22] Filed: Oct. 3, 1989

[51] Int. Cl.[5] ..... A61G 7/00

[52] U.S. Cl. ..... 5/60; 5/81 R; 5/86

[58] Field of Search ..... 5/60, 61, 81 R, 83, 5/84, 86, 67, 68; 297/DIG. 4

[56] References Cited

U.S. PATENT DOCUMENTS

| | | | |
|---|---|---|---|
| 1,710,821 | 4/1929 | Hackney | 297/DIG. 4 |
| 2,607,929 | 8/1952 | Balluff | 5/66 |
| 3,138,805 | 6/1964 | Piazza | 5/60 |
| 3,413,663 | 12/1968 | Swann | 5/60 |
| 4,240,169 | 12/1980 | Roos | 5/60 |
| 4,797,960 | 1/1989 | Vaiana | 5/81 R |

*Primary Examiner*—Gary L. Smith
*Assistant Examiner*—F. Saether
*Attorney, Agent, or Firm*—Wolf, Greenfield & Sacks

[57] ABSTRACT

This invention provides a combined bed and wheelchair wherein the bed frame and any mattress thereon have a cut-out extending from the foot end thereof. An insert having a head section, a center section and a foot section which are normally aligned in a common plane is adapted to fit in and substantially fill the cut-out. The sections are hingedly connected together with the insert being automatically transformable into a chair as the insert is removed from the frame. Wheels are connected to at least one section of the insert to permit the insert to be rolled and removed from the frame. The automatic transformation is preferably performed through the operation of first and second coacting elements mounted, respectively, to the frame and insert.

12 Claims, 6 Drawing Sheets

COMBINED BED AND WHEELCHAIR

FIELD AND BACKGROUND OF THE INVENTION

This invention concerns beds, and more particularly beds for the use of invalids or temporarily incapacitated persons.

It is well known that patients of the kind referred to above have to be taken from their beds, either for bathing or washing, for physiotherapeutical treatment or just to change their bodily position to avoid sores due to lying in the same position for extended periods of time.

The practice in hospitals, geriatric homes and like places where patients are cared for, these have to be lifted bodily from their beds or have to be assisted by nursing personnel and transferred to wheel chairs or other sitting commodities.

The said problem has been the subject of some attempts to alleviate the task of the hospital nurses and other paramedical staff, but—as far as I know—without effective result.

So, e.g. Swedish Patent No. 7314775-3 to B. Moe provides a wheel chair onto which a bed ridden patient can be transferred. In that construction a wheel chair is "integrated" with the bedstead and in use the invalid person has to be handled by nursing personnel, who have to change the person's position.

OBJECTS OF THE INVENTION

It is the object of the present invention to provide beds for invalids and other incapacitated persons which ease the task of nursing personnel in transferring patients from their beds to other seating means and also to perform this task in a way which is most convenient to the patient, ensuring that the patient—while assuming a sitting position stays on the bed, part of which is converted to seating accommodation.

SHORT SUMMARY OF DISCLOSURE

According to the invention and in order to meet the objects of the invention, there is provided a bedstead, the mattress supporting bed frame of which has a large cut-out area which is complementarily occupied by an insert comprising a multiple number of parts which are hingedly connected with one another and which—when these parts are made to be in a plane common to all of them, form part of the mattress surface, wheels being provided and being functionally connected to one or more of the said parts, the arrangement being that on removing the said insert from the bedstead, the said hingedly connected parts can be positioned relative to one another so that a wheel chair like sitting means is created.

In an embodiment of the invention the positioning of the said hingedly connected parts is effected automatically with the movement of the insert from the bedstead which initiates the transition of the insert from a part of the bed into a wheel chair.

SHORT DESCRIPTION OF DRAWINGS

The invention will now be described with reference to the annexed drawings which show the new bedstead schematically in different positions:

FIG. 1 being a perspective view of the bed.

FIG. 2 being a like view, parts being broken away to show details.

FIG. 3 being an intermediate position showing the insert being partly out of the cut-out area.

FIG. 4 showing the insert fully out of the cut out and being erected to form a wheel chair.

DETAILED DESCRIPTION

Figure 1:
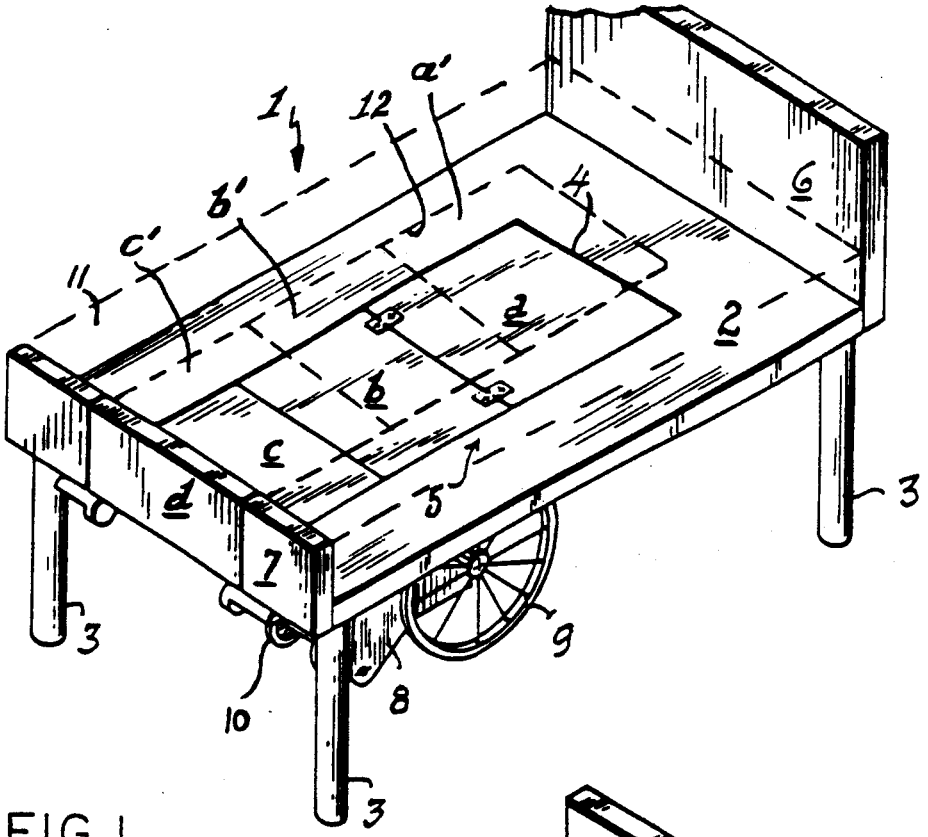

Turning first to the schematical view of FIG. 1, the bed indicated as a whole by the numeral 1 comprises a mattress supporting bed frame 2 which is carried on four legs 3 (only three of which are seen in the drawing).

In frame 2 is provided a large cut out area 4 in which is held an insert 5 comprising parts a, b, c and d.

The bed 1 has upstanding head part 6 and a foot part 7. Part 7 has a cut away portion which is occupied by the above mentioned part d of the insert 5. To part b of insert 5 are fixed at its underside two brackets 8 (only one being seen in the drawing) in which are journalled two wheels 9 (only one appearing in the drawing), and two small wheels or castors 10 (see FIG. 2).

Figure 2:
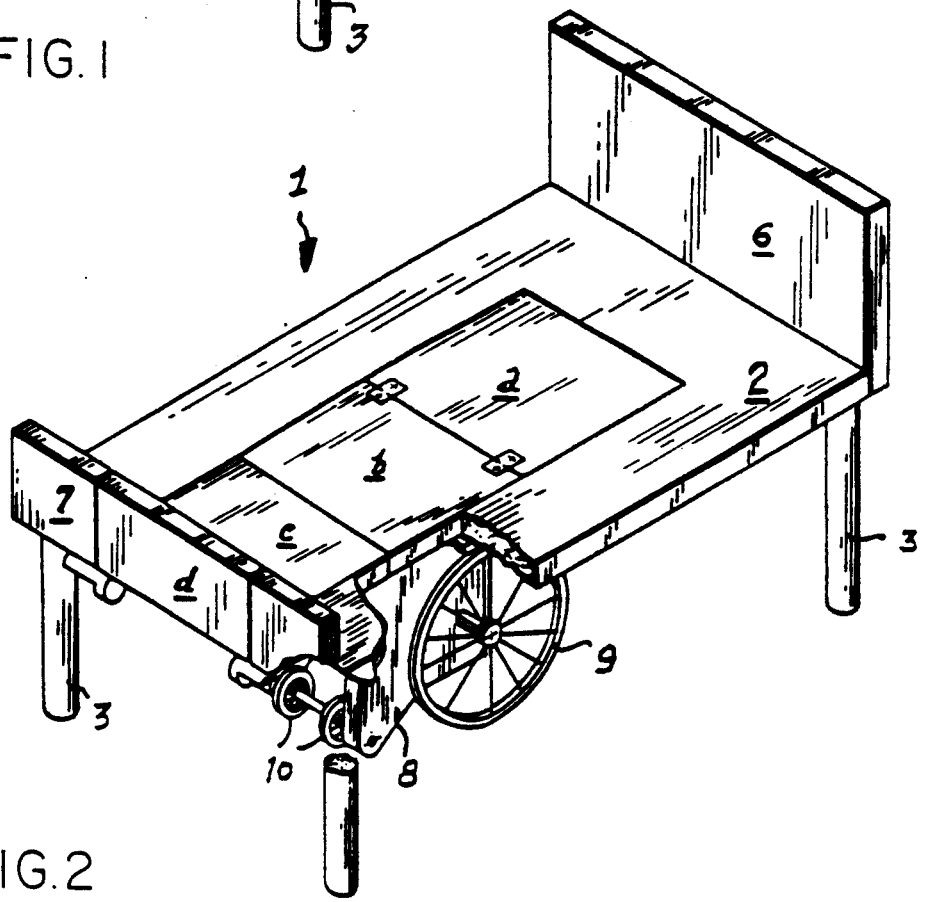
Figure 3:
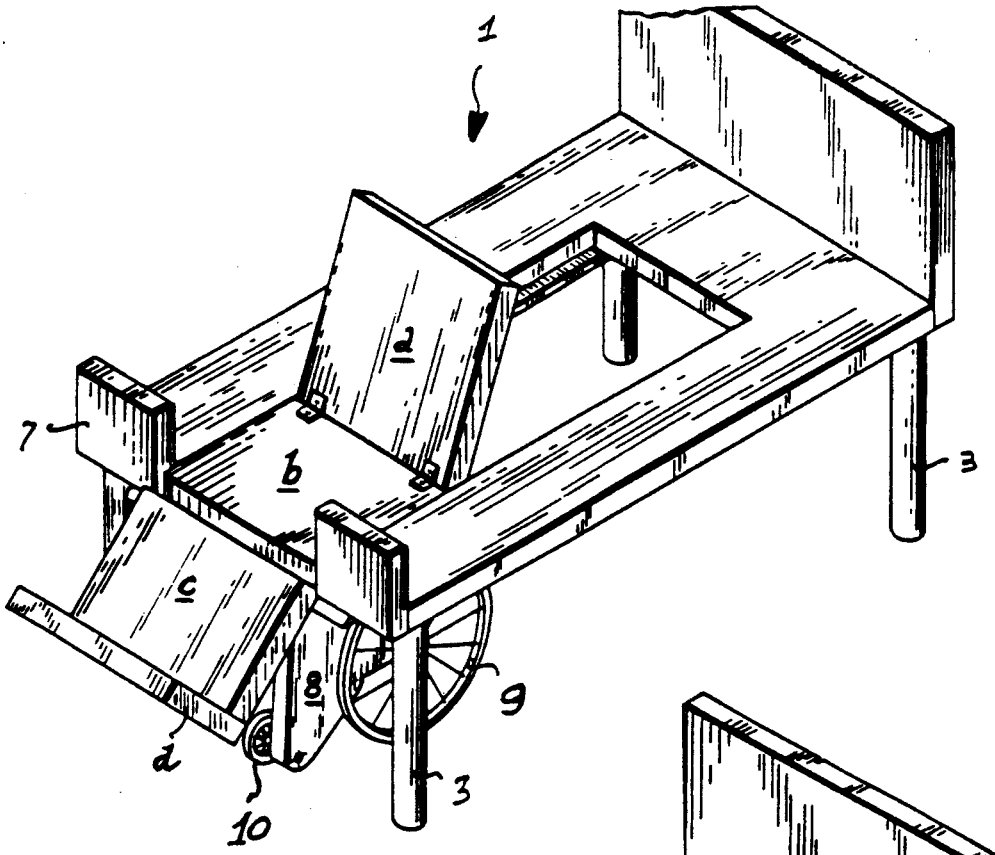

The bed frame 2 carries—in practice—a mattress 11 (shown in dotted lines in FIG. 1) which is formed leaving an empty space 12 corresponding to cut-out area 4. The parts a, b, c of insert 5 are upholstered (a', b' and c') and in position of FIGS. 1 and 2 are complementary to the above mentioned mattress, thus forming with the mattress proper a fully upholstered lying complement. Part d may be, but need not be upholstered.

Figure 4:
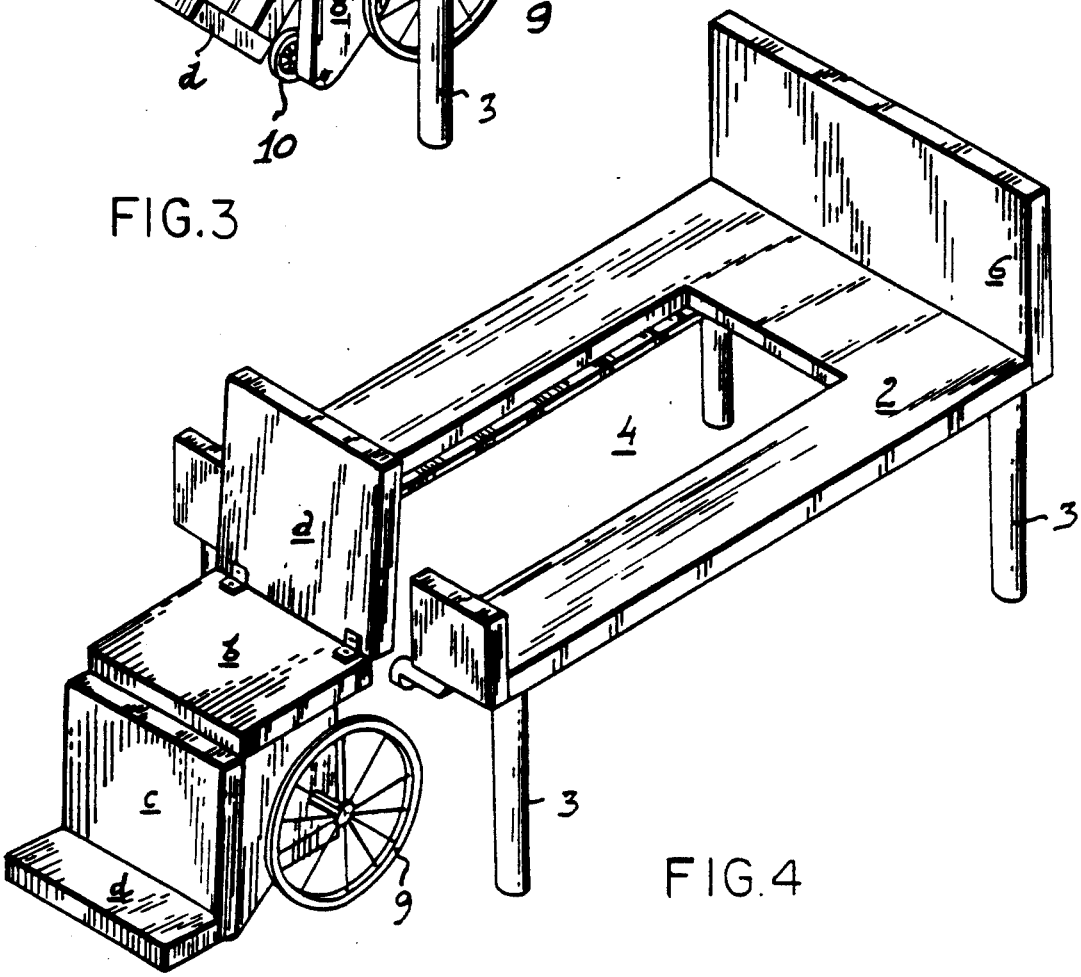

In practice—when it is desired to transfer a patient—the person is made to lie with her or his rump mainly on part b of insert 5 and her or his upper body on part a. Now the insert can be pulled out from the bed frame 2 travelling on wheels 9 and 10, part a having been erected and part c being swung downwardly, with part d extending therefrom practically at a right angle. In this way the position of FIG. 4 is obtained with the patient sitting in the erected wheel chair formed by parts a, b, c, d of insert 5.

Stops and abutments of a conventional kind are provided (although not shown in the drawing) fixing the relative positions of parts a, b, c and d.

Figure 5:
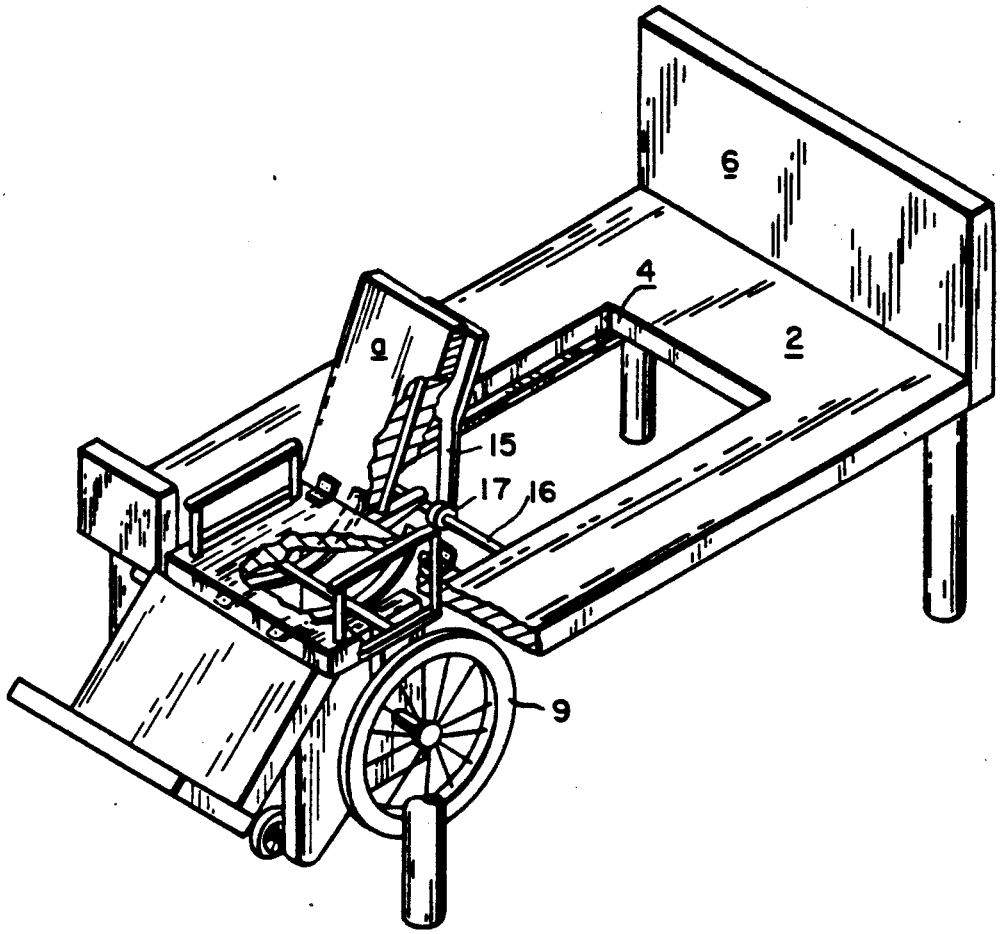
FIG. 5 is a perspective view of a further embodiment of the invention, parts of the bed being broken to show details.

The embodiment shown in FIG. 5 is in its main parts identical with the embodiment just described and illustrated by FIGS. 1–4. The same reference numerals as those used in connection with FIGS. 1–4 are used on FIG. 5. However in the embodiment of FIG. 5 parts have been added to insert 5 causing the parts a, b to assume automatically those positions which they have to assume in order to serve as a wheel chair.

Figure 6:
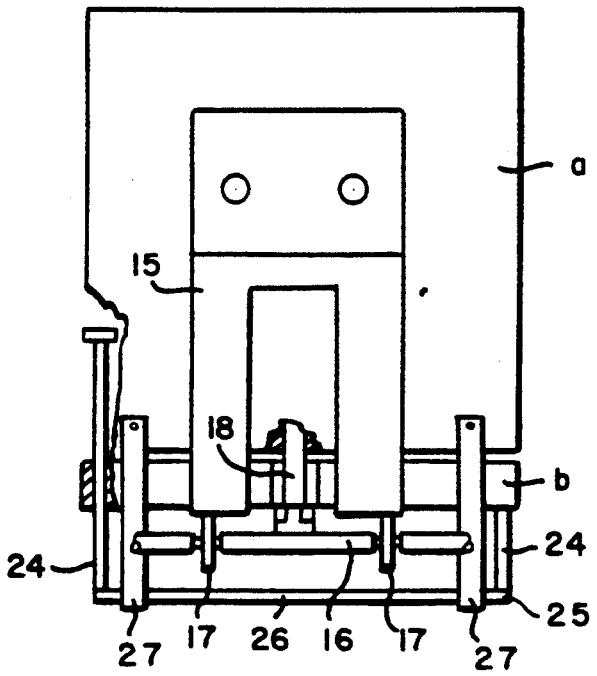
FIGS. 6 and 7, illustrate details of the embodiment of FIG. 5.
Figure 7:
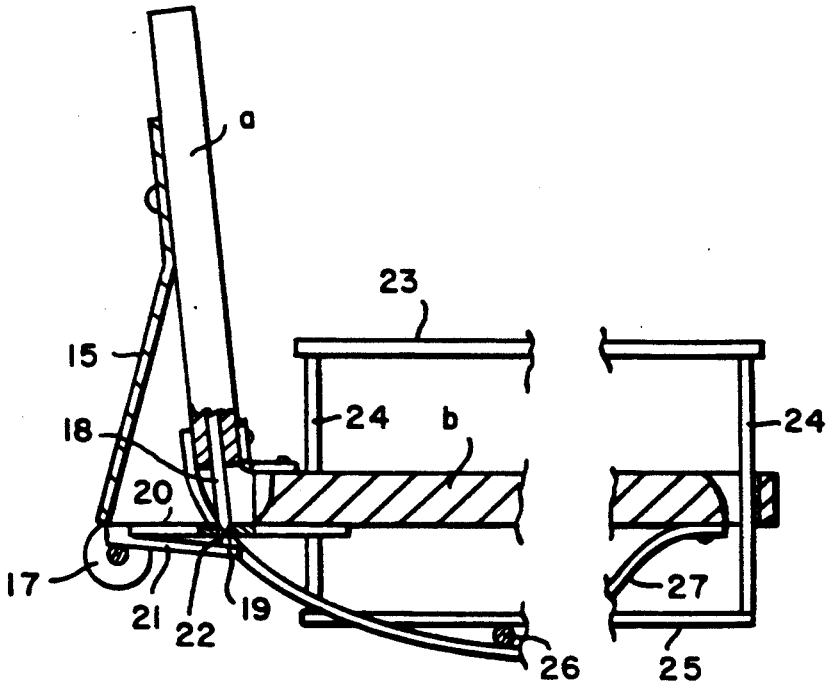

At the rear side of part a of insert 5, i.e. the part which serves as back support in the position assumed by the insert parts when pulled out and forming a wheel chair, there are provided two slightly rearwardly oblique flat rails 15 (see also FIGS. 6 and 7). In the cut-out 4, at a level below the free ends of rails 15 is fixedly held a shaft 16 extending across cut out 4. On shaft 16 turn two idle rollers 17 which are in register with the ends of rails 15. Within part a and extending downwardly beyond the lowermost edge of that part is provided a central rod 18 whose lowermost end enters a hole 19 in a plate member 20 fixed to part b (see FIG. 7). To member 20 is swingingly hinged a lever 21. Lever 21 carries on its upper surface a small stud 22 which—when level 21 is swung towards member 20—abuts against the end of rod 18 in hole 19. Lever 21 rests on a roller 30.

In its "wheel chair position" the insert 5 should have arm rests for the person sitting in it. These arm rests—however—should not inaccommodate the occupier of the bed lying on the complete mattress area.

The arm rests comprise the horizontal supports 23 for the person's arms carried on two vertical supports 24. These latter are connected by a horizontal bar 25 at their lower ends. Between the two bars 25 and connected to both extends a round bar 26. To the lowermost portion of part a and the undersides of parts b and a slung below bar 26 extend two strips 27 of material, such as webbing or leather.

Figure 8:
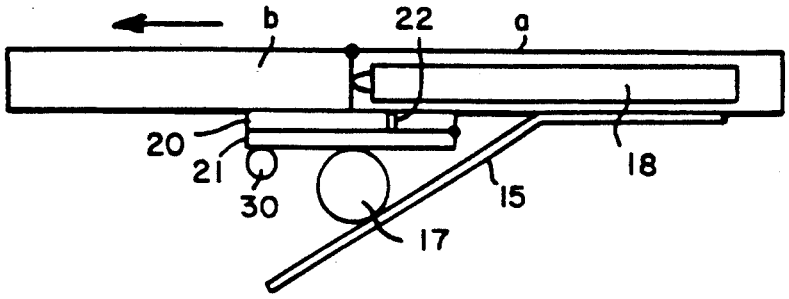
FIGS. 8–13 are schematical, elevational views of the insert, illustrating the function thereof in connection with the embodiment of FIG. 5.
Figure 9:
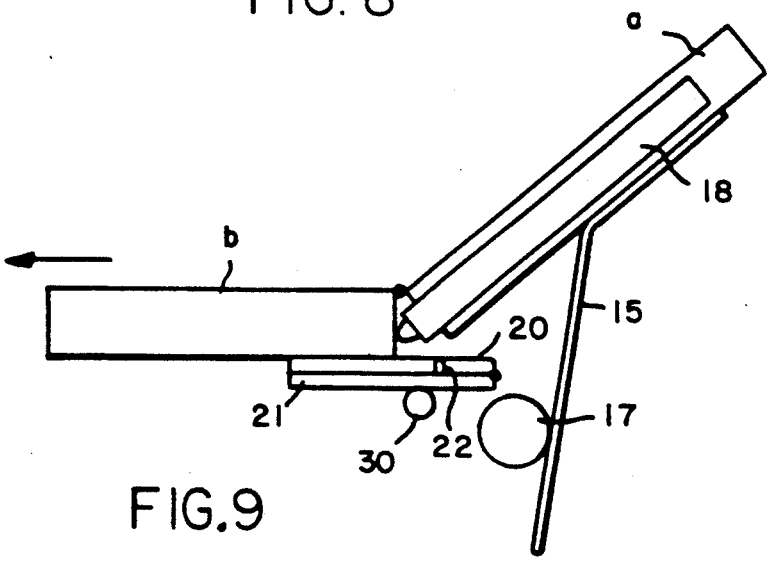
Figure 10:
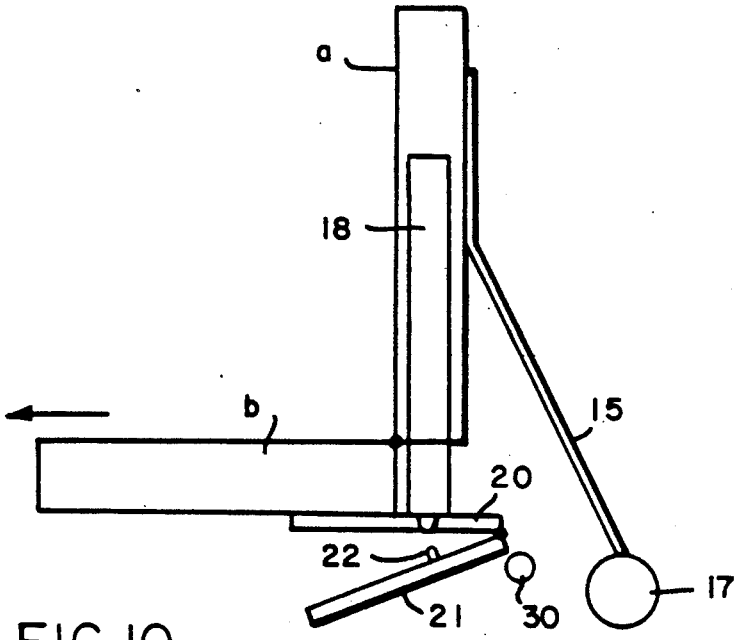
Figure 11:
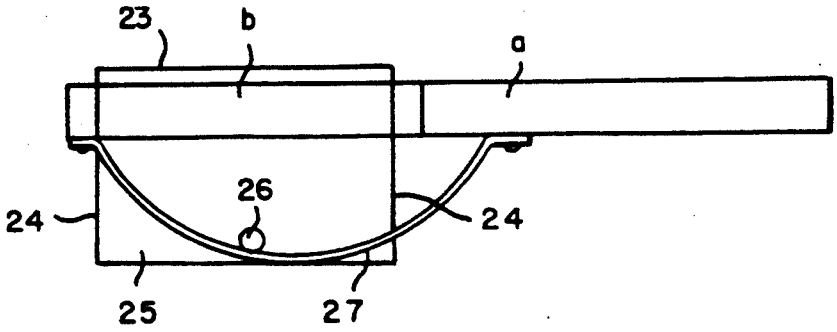
Figure 12:
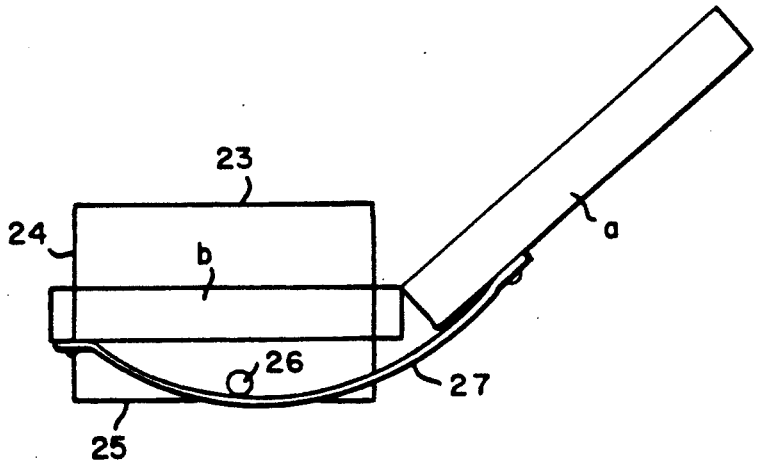
Figure 13:
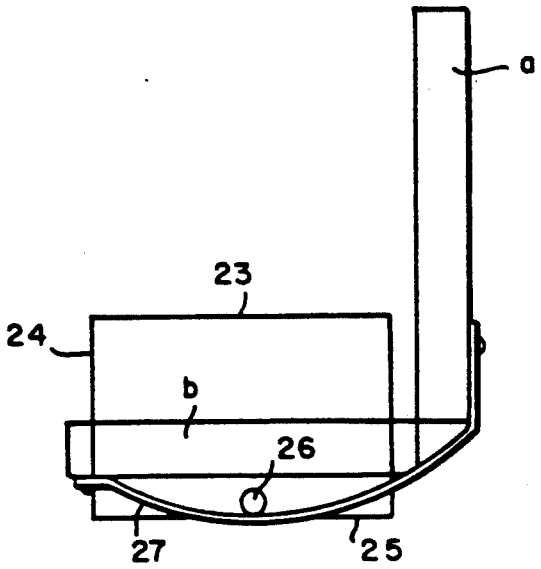

The embodiment shown in FIG. 5, particularly the parts shown in FIGS. 6 and 7 function, as will now be explained with the aid of the schematical views of FIGS. 8–10 and FIGS. 11–13. For the sake of clarity FIGS. 8–10 show different positions of the insert 5 and appended parts of its constituents, while FIGS. 11–13 show the insert in identical positions of other constituent parts. In fact, in practice FIGS. 8 and 11, FIGS. 9 and 12, FIGS. 10 and 13 identify the same position of the insert parts.

Turning first to FIGS. 8 and 11, part b and a of the insert are both horizontal and form part of the mattress. Now, when the insert 4 is pulled in the direction towards the foot end of the bed (see arrow in FIG. 8) the two rails 15 gliding on rollers 17 cause the part a to erect, and passing through a position according to FIG. 9, eventually assuming the position of FIG. 10, i.e. being fully upright. In this final position the rails 15 are no longer sliding on rollers 17. Due to the movement of part b in the direction of the arrow, lever 21 slides on roller 30 and eventually drops away from member 20 (FIG. 9). Now the lower end of rod 18 enters the hole in member 20 and thus is stabilized and adapted to hold part a (the back support) in upright position.

Simultaneous with the movement according to FIGS. 8, 9, 10 (which—as far as parts a and b are concerned) is seen also in FIGS. 11, 12, 13, the straps 27, which in FIG. 10 appear to be slung loosely about bar 26, become stretched with the erection of part a, thus by raising bar 26 cause the arm rest comprising bars 23, 24, 25 to rise from position of FIG. 11 via position of FIG. 12 to the position of actual use according to FIG. 13 and—incidentally—contributing to the stability and rigidness of the assembly as a whole.

It will be seen that the use of the new invalid's bed's not only facilitates the work of nursing and paramedical personnel, but also inconveniences a patient to a minimal degree, since that person need not be lifted or turned around, the only change of position of that person being to rising from a lying to a sitting position, a movement which in my cases can be brought about with the erection of the part a.

Certain changes in the construction described and shown in the drawings would be within the gist of the invention. So, the cut-out and the respective insert instead of being in the centre of the bed frame could be nearer to one of the longitudinal edges thereof. Parts a and c of the insert could be made to be swingable relative to part b, such that they continue to form part of the mattress surface, while the head part or the foot part of the bed is lifted.

Thus, while the invention has been particularly shown and described above with respect to preferred embodiments, the foregoing and other changes in form and detail may be made therein while still remaining within the spirit and scope of the invention.

What is claimed is:

1. A bed for use by invalids and incapacitated persons comprising: a bed frame and a mattress, the said mattress and bed frame having complementary cut-out areas, an insert comprising a multiple number of upholstered parts which are hingedly connected with one another, said insert when its parts are made to be in a common plane, fitting in and substantially filling said cut-out area and forming part of the mattress surface, the said hingedly connected parts extending in succession to each other from near a head part of the bed to, and including an opposite foot part of the bed, wheels functionally connected to at least one of said insert parts, said insert being removable from the frame, and means a means disposed on said bed frame and cooperating with said insert for automatically transforming said insert into a chair as said insert is removed from the frame.

2. A bed according to claim 1 wherein the one of the insert parts which is nearest to said head part has two slightly rearwardly oblique rails extending from its rear side, which rails are in register with stationary idle rollers revolving on a shaft extending within said cut-out area.

3. The bed according to claim 2 wherein the said one insert part includes a rod whose lowermost end enters a hole in a plate member affixed to the insert parts connected to said one insert part, a lever swingingly hinged to that plate, said lever carrying on its upper surface a stud which is placed to enter from below the hole in the said plate member, and a stationary roller, the said lever normally resting on the stationary roller, with the roller being removed from engagement with the lever whenever the insert parts are moved.

4. The bed according to claim 2 wherein said one insert part may be erected to an upright position and including arm rests having upper and lower horizontal members interconnected by vertical members, a bar connecting said lower horizontal members, at least one strap, one end of which strap is affixed to said one insert part which and the other end of which is connected to said nearest insert part, the strap being slung about the bar connecting said lower horizontal members of the arm rest, so that with erection of said one insert part, the strap is stretched and thereby lifts the arm rest assembly.

5. A combined bed and wheelchair comprising:

a bed frame having a head end and a foot end;

a cut-out formed in said frame and extending from the foot end thereof;

an insert having at least a head section, a center section and a foot section, each said sections being hingedly connected to each adjacent section, said sections being normally aligned in a common plane and adapted when so aligned to fit in and substantially fill said cut-out, said head section being erectable to a substantially upright orientation and said foot section being lowerable to transform said insert into a chair having a back, seat and leg support;

wheel means connected to at least one section of said insert to permit said insert to be rolled and removed from said frame; and means a means disposed on said bed frame and cooperating with said insert for automatically transforming said insert into a chair as said insert is removed from the frame.

6. A bed and wheelchair as claimed in claim 5 wherein said bed frame includes a footboard having a cut-out formed therein; and wherein said insert includes a foot projection extending at substantially a right angle from the foot end of said foot section and sized to substantially fill said footboard cut-out when said insert is in the frame cut-out, said foot projection functioning as a foot rest when the insert is transformed to a chair.

7. A bed and wheelchair as claimed in claim 5 wherein said wheel means includes a large wheel mounted for rotation on either side of said insert and at least one small wheel.

8. A bed and wheelchair as claimed in claim 5 wherein said automatic transforming means includes first coacting means mounted to said head section and second coating means mounted to said frame, said coacting means interacting when said insert is removed from the frame to erect the head section to its substantially upright position.

9. A bed and wheelchair as claimed in claim 8 wherein said first coacting means is an angled rail extending from the back of said head section and said second coacting means includes an idler roller in register with each said rail.

10. A bed and wheelchair as claimed in claim 6 including means for securing said head means in its upright position when said insert is transformed to a chair; and means for releasing said securing means when the insert is to be returned to its normal common-plane alignment.

11. A bed and wheelchair as claimed in claim 5 including retractable armrest means mounted on either side of said insert, said insert being retracted when said sections are aligned in a common plane, and being raisable to a functional position when said insert is transformed to a chair.

12. A bed and wheelchair as claimed in claim 11 including means for automatically moving said armrest means between its retracted and functional positions.

* * * * *